United States Patent [19]

Suda et al.

[11] Patent Number: 4,686,165

[45] Date of Patent: Aug. 11, 1987

[54] SUBSTRATE FOR AMORPHOUS SILICON PHOTORECEPTOR

[75] Inventors: Fumiyuki Suda; Masaru Yasui, both of Yokohama; Kazuhiro Miyamoto, Tokyo, all of Japan

[73] Assignee: Stanley Electric Co., Ltd., Tokyo, Japan

[21] Appl. No.: 755,270

[22] Filed: Jul. 15, 1985

[30] Foreign Application Priority Data

Jul. 17, 1984 [JP] Japan ..... 59-147004

[51] Int. Cl.[4] ..... G03G 5/082; G03G 5/10

[52] U.S. Cl. ..... 430/69; 430/84

[58] Field of Search ..... 430/69, 84

[56] References Cited

U.S. PATENT DOCUMENTS 4,265,991 5/1981 Hirai et al. ..... 430/84 X 4,405,703 9/1983 Onuma et al. ..... 430/69

FOREIGN PATENT DOCUMENTS 59-119361 7/1984 Japan ..... 430/69

*Primary Examiner*—Roland E. Martin

*Attorney, Agent, or Firm*—Spensley Horn Jubas & Lubitz

[57] ABSTRACT

A substrate for an amorphous silicon photoreceptor prepared by first forming an amorphous silicon photoreceptive layer on an aluminum or aluminum alloy body by using a plasma CVD apparatus, and by arranging so that those crystal grains located in the surface of the substrate each has a diameter of 1 cm or smaller, to thereby make it possible to obtain a satisfactory image stably and repetitively.

4 Claims, 3 Drawing Figures

SUBSTRATE FOR AMORPHOUS SILICON PHOTORECEPTOR

BACKGROUND OF THE INVENTION (a) Field of the invention

The present invention relates to a substrate for an amorphous silicon photoreceptor for electrophotography.

(b) Description of the prior art

There has been developed, of late, a technique of forming a non-crystalline silicon film containing hydrogen atoms (hereinafter to be called briefly a-Si film) on a substrate by decomposing silane gas by a glow discharge and relying on the plasma CVD (Chemical Vapor Deposition) technique. This a-Si film has been put to practice as a semiconductor material which allows the control of its conductivity type and carrier density for the manufacture, at a low cost, of various semiconductor devices of a relatively large area such as solar batteries and thin-film transistors. Also, very recently, the level of technique of this field has made a progress to such a stage that a-Si films having a high resistivity can be obtained with good reproducibility. Therefore, an a-Si film having a high resistivity and being deposited on top of a metal substrate such as aluminum chip has been attracting the interest of those concerned as the material of a photoreceptor for electrophotography which is able to exhibit an excellent property including photoreceptability and mechanical strength. Thus, extensive research and development of such a-Si as a material replacing conventional photoreceptive materials such as selenium (Se) are under way.

An example of the apparatus for the manufacture of such conventional a-Si photoreceptor for electrophotography is shown in FIG. 1. Reference numeral 1 represents a reaction chamber, and this reaction chamber is coupled to an air evacuator 2 for evacuating the interior of the chamber to produce substantial vacuum. A substrate 3 for a photoreceptor is set within this reaction chamber 1. This substrate 3, however, requires to possess an electro-conductivity, so that aluminum (Al) or an Al alloy is used in general as the material thereof. The substrate is provided often in the form of a cylinder in view of the consideration that the substrate 3 is incorporated in a copying machine and like devices. The substrate 3 is arranged to be rotatable within the reaction chamber 1 through a rotator means 4, and moreover arrangement is provided so that the substrate 3 can be subjected to an appropriate temperature at the time of formation of an a-Si film by means of an electric heater 5 provided within the cylindrical substrate 3 and connected to an external power supply 6.

Within the reaction chamber 1, there is provided a cylindrical electrode 7 surrounding the abovesaid cylindrical substrate 3. This electrode 7 is provided with a plurality of gas ejection orifices 8 formed through the wall thereof. These orifices are connected to a gas supply means 9 provided externally of the reaction chamber 1 to be supplied with a material gas such as $SiH_4$ and other material gases so that the gas ejects into the interior of the electrode 7 under pressure through these orifices 8. A radio frequency electric power is supplied to the electrode 7 from a radio frequency power supply 10 which is connected to this electrode 7 to develop a glow discharge between the electrode 7 and the substrate 3 at an appropriate substrate temperature and under an appropriate gas pressure. As a result, $SiH_4$ gas and other starting material gases which are supplied into the reaction chamber from the gas supply means 9 are decomposed by the glow discharge, so that a-Si containing silicon hydride is deposited on the surface of the substrate 3. In order to obtain an a-Si film having a high resistivity, such a technique as to include certain volumes of $N_2$ gas and $B_2H_6$ gas into the $SiH_4$ gas is adopted.

Now, the thickness of an a-Si film which is required for a photoreceptor for electrophotography is said to be in the range of 5 to 50 $\mu$m, preferably 10 to 30 $\mu$m. With respect to the basic physical property, the layer structure, the layer composition of an a-Si layer itself and also to the manufacturing method of the a-Si layer, there have been and are being made various researches and developments. However, it is the present state of art that hardly any study is being made with respect to the effect, on the property of the photoreceptor, of the a-Si layer serving both as the supporting member and also as the electroconductive material for the substrate of the photoreceptor.

As the material of the substrate of a photoreceptor for electrophotography, metals are desirable because the substrate is required in general to have an electroconductivity. Also, owing to the fact that the formation of an a-Si layer as a film to be provided on top of the substrate is performed while heating the interior of the reaction chamber, so that the substrate requires to be free from being deformed by the application of heat. Furthermore, the substrate is required to be good in workability, i.e. must be easily processed, for the convenience when it is incorporated or mounted in a copying machine, a printer or like devices, and also it is required to have a substantially high mechanical strength, a light weight and a long service life. Not only that, but also the substrate is required to have the property of not giving any adverse effect on the image which is to be obtained. On the basis of these requirements, such metals as aluminum (Al) or aluminum alloys are widely adopted as the material to constitute the substrate of a photoreceptor. This substrate is obtained by first relying on either the extrusion technique or the drawing technique to provide a raw cylindrical structure, and then it is subjected to surface grinding or abrading. In the step prior to the deposition of an a-Si film onto this substrate, it is usual to subject the surface of the substrate to mirror grinding and fat-removing cleaning steps.

The present inventor has discovered that the abovesaid various items of the property of a photoreceptor are markedly affected depending on the quality and property of the substrate employed, and has proposed, in Japanese Patent Application No. Sho 58-135957 Specification, specific conditions concerning the quality and property of alumium alloys for use as the constituting material of the substrate of a photoreceptor. However, as a result of the subsequent detailed experiments conducted by the present inventor, it has been found that, even when the quality and property of the substrate employed are not changed, the crystal grains which are present in the surface of the substrate metal could vary in size due to the difference in the manufacturing methods as well as the processing techniques of the aluminum or aluminum alloy, and that such variation in size of the crystal grains would greatly affect the quality of the electrophotographic image which is to be obtained.

SUMMARY OF THE INVENTION

It is, therefore, the principal object of the present invention to provide a substrate of an a-Si photoreceptor which allows stable repetitive acquisitions of a good quality image.

In order to attain the above-mentioned objects, the present invention features the use of aluminum or an aluminum alloy as the material of the substrate of an amorphous silicon photoreceptor which is to be mounted in an electrophotographing apparatus, and also features the setting of the size of the crystal grains which are present in the surface of the substrate at such a largeness as substantially will not affect the quality of the image which is to be obtained. Concretely, the present invention features the use of crystal grains of a diameter of 100 microns or smaller.

According to the present invention, it is possible to faithfully reproduce an image and to obtain its copies or prints of an excellent quality without developing undesirable bright and dark patches, i.e. uneven shade, in the obtained image attributable to those crystal grains which appear in the surface of the substrate of an a-Si photoreceptor.

This and other objects of the present invention will become more apparent during the course of the following detailed description and the appended claims.

DETAILED DESCRIPTION OF THE PREFERRED EMBODIMENT

The present invention will hereunder be described in further detail with respect to an embodiment thereof and in comparison with the conventional art.

Figure 1:
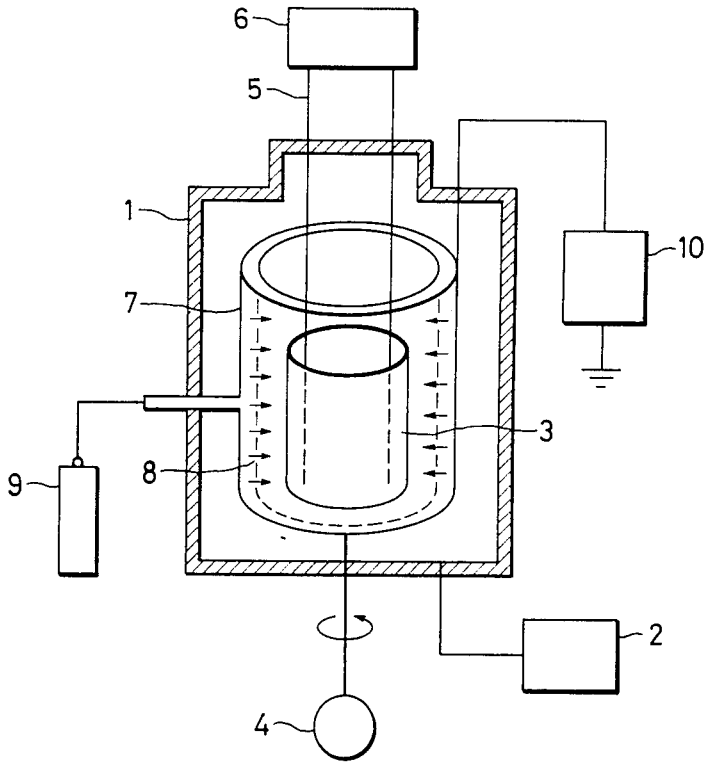
FIG. 1 PRIOR ART
FIG. 1 is a general diagrammatic illustration of a conventional plasma CVD apparatus for use in manufacturing an a-Si photoreceptor.
Figure 2:
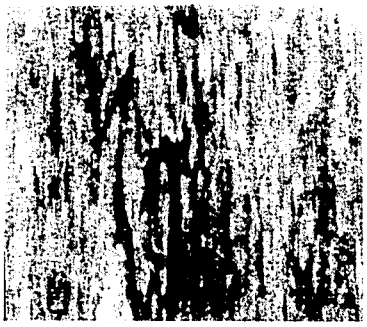
FIG. 2 PRIOR ART
FIG. 2 is a photograph of a copied image produced by an a-Si photoreceptor using a conventional substrate made of an aluminum alloy.

FIG. 2 is a sample of a copy of a black contact print obtained by using an a-Si photoreceptor manufactured according to the conventional method without setting the size of the crystal grains. As the substrate of this a-Si photoreceptor, an aluminum alloy (JIS 3003-JIS is the abbreviation of Japan Industrial Standard) is used, and on top of this substrate there has been deposited an a-Si film up to the thickness of 20 μm. The crystal grains which are present in the surface of this aluminum alloy substrate have a maximum diameter of about 2 cm. As will be apparent from FIG. 2, it has been found that the brights and darks of the image are exhibited in correspondence to the size and the shape of the crystal grains of the substrate metal. The reason why the size and the shape of the crystal grains of the substrate surface affect the quality of the image is considered to be explained as follows.

An a-Si photoreceptive layer is formed to a small thickness which is about 50 μm at the maximum. In order to obtain this photoreceptive layer of a high quality on a mass production basis, a plasma CVD technique is relied upon. It is the common opinion that the growth process of the a-Si film according to this known technique may be a sort of surface reaction which occurs in such a way that $SiH_4$ gas and other starting material gases are decomposed into radicals (free radicals) by a glow discharge applied thereto, and that these radicals deposit onto the surface of the substrate to turn into a-Si progressively. Accordingly, the a-Si layer which is deposited progressively on the surface of the substrate is inferred to undergo, in large measure, an epitaxial-like growth while depending to some extent on the orientation of the crystals existing in the substrate surface. Accordingly, also from the fact that the film which is obtained has a small thickness, it is considered that there is formed an a-Si layer having film qualities corresponding to the orientation, the size and the shape of the crystal grains at respective sites in the surface of the substrate, and that these factors come to the fore as uneven brights and darks in the image obtained. Also, the compositions of the respective crystal grains which are formed at the time crystals are solidified during the manufacturing process of the aluminum alloy substrate would differ somewhat for each crystal grain, and there would be present some degree of potential barriers at the interfaces between or in the boundaries of respective crystal grains. As a result, depending on the respective crystal grains, there will be some differences in the amount of the carriers injected from the substrate side into the a-Si layer—which is one type of image-forming process, and this is considered also to be the cause for such uneven darks and brights appearing in the copy shown in FIG. 2.

As discussed above, there has been found that the size and the shape of the crystal grains existing in the surface of the substrate intensively affect the quality of the image which is provided by the a-Si photoreceptor. In order to solve this problem, it has been found most effective to restrict the size of the crystal grains not to surpass a specific value.

Figure 3:
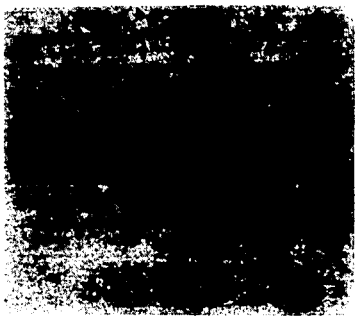
FIG. 3 is a photograph of a copied image produced by an a-Si photoreceptor using a substrate similar to that of FIG. 2 but prepared according to the present invention.

FIG. 3 is a sample of a copied image similar to that of FIG. 2 from a black contact print prepared under similar copying conditions to those of FIG. 2, using an a-Si layer of the same film thickness as that of the a-Si layer of FIG. 2 formed under the same conditions as for those of FIG. 2, setting the crystal grains so as to have a size of about 100 μm according to the present invention which are to appear in the surface of the substrate made of an aluminum alloy (JIS 3003). The processing of the substrate such as grinding and cleaning were performed in the same way as for the conventional case. The result was that no undesirable pattern of darks and lights appeared, and an image of a very good quality was obtained.

The size of the crystal grains present in the surface of the substrate may differ somewhat depending on the type of the image to be obtained. If, however, the importance is placed on faithful reproduction of an image, the following conclusion was made as a result of various experiments that the size of the crystal grains is to be set at about 1 cm at most, usually at 100 μm or smaller, and preferably 20 μm or smaller.

Next, in order to set the size of the crystal grains present in the surface of the substrate at the specific value mentioned above or smaller, there is adopted, for example, the following technique.

(a) In the step of solidifying aluminum or an aluminum alloy from its molten state, the molten metal is subjected to irradiation of an ultrasonic wave. Pulverization of or minimizing the size of the crystal grains by the application of an ultrasonic wave is achieved by the destroying action applied to the grains by the frictional force and the cavitation action working between the initial crystal grains and the molten metal.

(b) The aluminum or the aluminum alloy which is employed is subjected to annealing which is performed by heating the metal for an extended period of time at a temperature immediately below the solidus line to reduce the size of the crystal grains, and at the same time to diffuse the components to uniformalize the composition.

(c) The metal which is located at the temperature region in which the shifting of phase from the liquid phase to solid phase takes place is then cooled at an appropriate rate, to thereby control the development of nuclei from the molten metal as well as the rate of growth thereof to pulverize or minimize the size of the crystal grains. In general, the greater the rate of cooling becomes, the easier occurs an excessive cooling phenomenon such that the rate of development of nuclei increases, and at the same time there arises a shortage of supply of solute atoms due to diffusion, causing a delay of growth of new phases, and as a result the composition of the crystals becomes finer.

It will be desirable if the size of the crystal grains in the surface of the substrate can be minimized in the above-mentioned appropriate manner. It should be noted, however, that even when attempt is made to minimize the size of the crystal particles of the aluminum or aluminum alloy body which constitutes the substrate, there could arise such an inconvenience that, if for example an extrusion or drawing is performed to provide a cylindrical raw tube, the crystal composition thereof would be also drawn or pulled along the direction of the applied force in such a tube-making process. Accordingly, it will be necessary to give consideration to maintaining the minimized size of grains also in such a final finishing step of the substrate as the surface grinding or abrading, and also in the etching step of the substrate.

What is claimed is:

1. An amorphous silicon photoreceptor element, comprising:

an electroconductive metal substrate made of aluminum or an aluminum alloy; and an amorphous silicon photoreceptive layer deposited on said substrate by using a plasma CVD apparatus, wherein:

said substrate has, formed on its surface, crystal grains each having diameter not exceeding about 100 microns.

2. A photoreceptor element according to claim 1, in which:

said aluminum or aluminum alloy is prepared by irradiating thereonto an ultrasonic wave in its stage of being solidified from its molten state.

3. A photoreceptor element according to claim 1, in which:

said aluminum or aluminum alloy is prepared by being subjected to annealing.

4. A photoreceptor element according to claim 1, in which:

said aluminum or aluminum alloy is prepared by being cooled at a predetermined rate in a temperature region in which a phase change from liquid phase into solid phase takes place.

* * * * *